US009304472B2

(12) United States Patent
Ishikawa

(10) Patent No.: US 9,304,472 B2
(45) Date of Patent: Apr. 5, 2016

(54) IMAGE FORMING APPARATUS HAVING A CHANGING SECTION FOR CHANGING THE WIDTH OF A TRANSFER SECTION

(71) Applicant: FUJI XEROX CO., LTD., Minato-ku, Tokyo (JP)

(72) Inventor: Takatoshi Ishikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/975,624

(22) Filed: Aug. 26, 2013

(65) Prior Publication Data

US 2014/0199089 A1 Jul. 17, 2014

(30) Foreign Application Priority Data

Jan. 11, 2013 (JP) ..... 2013-003458

(51) Int. Cl.
*G03G 15/00* (2006.01)
*G03G 15/16* (2006.01)

(52) U.S. Cl.
CPC ..... *G03G 15/6558* (2013.01); *G03G 15/1605* (2013.01); *G03G 15/167* (2013.01); *G03G 15/168* (2013.01); *G03G 2215/0154* (2013.01)

(58) Field of Classification Search
CPC ..... G03G 15/6558; G03G 15/605; G03G 15/167; G03G 2215/0154
USPC ..... 399/45, 66
See application file for complete search history.

(56) References Cited

U.S. PATENT DOCUMENTS 6,115,562 A * 9/2000 Ogawa et al. ..... 399/66
7,155,153 B2 * 12/2006 Taguchi ..... 399/316
7,606,507 B2 * 10/2009 Soshiroda ..... 399/66
8,036,550 B2 * 10/2011 Minbu ..... 399/45

(Continued)

FOREIGN PATENT DOCUMENTS

JP 11-143254 A 5/1999
JP 2003131494 A * 5/2003

(Continued)

OTHER PUBLICATIONS

Machine Translation of Honda, Makoto. Toner Image Transfer Device. Oct. 29, 2001, Japanese Patent Office. JP2003-131494.*

(Continued)

*Primary Examiner* — Clayton E LaBalle
*Assistant Examiner* — Trevor J Bervik
(74) *Attorney, Agent, or Firm* — Sughrue Mion, PLLC

(57) ABSTRACT

An image forming apparatus includes an intermediate transfer belt that is stretched by multiple rollers, the intermediate transfer belt transporting a toner image on an outer peripheral surface, a second transfer member that performs second transfer, the second transfer transferring the toner image on the intermediate transfer belt to a recording medium, an opposed member that abuts against an inner peripheral surface of the intermediate transfer belt, the opposed member being opposed to the second transfer member, and a changing section that changes a width of contact between the intermediate transfer belt and the second transfer member at a second transfer position, on a basis of paper attribute information of the recording medium, the second transfer position being a position where the second transfer member abuts against the opposed member with the intermediate transfer belt being sandwiched between the second transfer member and the opposed member.

13 Claims, 9 Drawing Sheets

(56) References Cited

U.S. PATENT DOCUMENTS

| | | | | |
|---|---|---|---|---|
| 8,059,980 | B2 * | 11/2011 | Okamoto | 399/66 |
| 8,175,477 | B2 * | 5/2012 | Ishikawa | 399/66 |
| 8,208,823 | B2 * | 6/2012 | Yoshioka | 399/45 |
| 8,219,001 | B2 * | 7/2012 | Sendo et al. | 399/121 |
| 2010/0142985 | A1 * | 6/2010 | Minbe et al. | 399/66 |
| 2010/0215387 | A1 * | 8/2010 | Ishikawa | 399/45 |
| 2011/0026954 | A1 * | 2/2011 | Kishi | 399/44 |
| 2012/0155897 | A1 * | 6/2012 | Torimaru | 399/44 |

FOREIGN PATENT DOCUMENTS

| | | | |
|---|---|---|---|
| JP | 2005-316320 | A | 11/2005 |
| JP | 2012-163730 | A | 8/2012 |

OTHER PUBLICATIONS

Japanese Office Action issued in Japanese Application No. 2013-003458 dated Jan. 26, 2016.

* cited by examiner

OFFSET ANGLE 0°

OFFSET ANGLE 12°

| OFFSET ANGLE (°) | 6 | 8 | 10 | 12 |
|---|---|---|---|---|
| IMAGE DISTURBANCE EVALUATION GRADES | G1.5 | G2 | G3 | G4 |

IMAGE FORMING APPARATUS HAVING A CHANGING SECTION FOR CHANGING THE WIDTH OF A TRANSFER SECTION

CROSS-REFERENCE TO RELATED APPLICATIONS

This application is based on and claims priority under 35 USC 119 from Japanese Patent Application No. 2013-003458 filed Jan. 11, 2013.

BACKGROUND

Technical Field

The present invention relates to an image forming apparatus.

SUMMARY

According to an aspect of the invention, there is provided an image forming apparatus including an intermediate transfer belt that is stretched by multiple rollers, the intermediate transfer belt transporting a toner image on an outer peripheral surface, a second transfer member that performs second transfer, the second transfer transferring the toner image on the intermediate transfer belt to a recording medium, an opposed member that abuts against an inner peripheral surface of the intermediate transfer belt, the opposed member being opposed to the second transfer member, and a changing section that changes a width of contact between the intermediate transfer belt and the second transfer member at a second transfer position, on a basis of paper attribute information of the recording medium, the second transfer position being a position where the second transfer member abuts against the opposed member with the intermediate transfer belt being sandwiched between the second transfer member and the opposed member.

BRIEF DESCRIPTION OF THE DRAWINGS

Exemplary embodiment of the present invention will be described in detail based on the following figures, wherein.

DETAILED DESCRIPTION

Next, the present invention will be described in further detail with reference to the figures, by way of its exemplary embodiment and specific examples. However, the present invention is not limited to the exemplary embodiment and specific examples.

It should be noted that in the following description made with reference to the figures, the figures are for illustrative purposes only, and the ratios among various dimensions and the like differ from the actuality. For the ease of understanding, components other than those required for explanation are not illustrated as appropriate.

Figure 1:
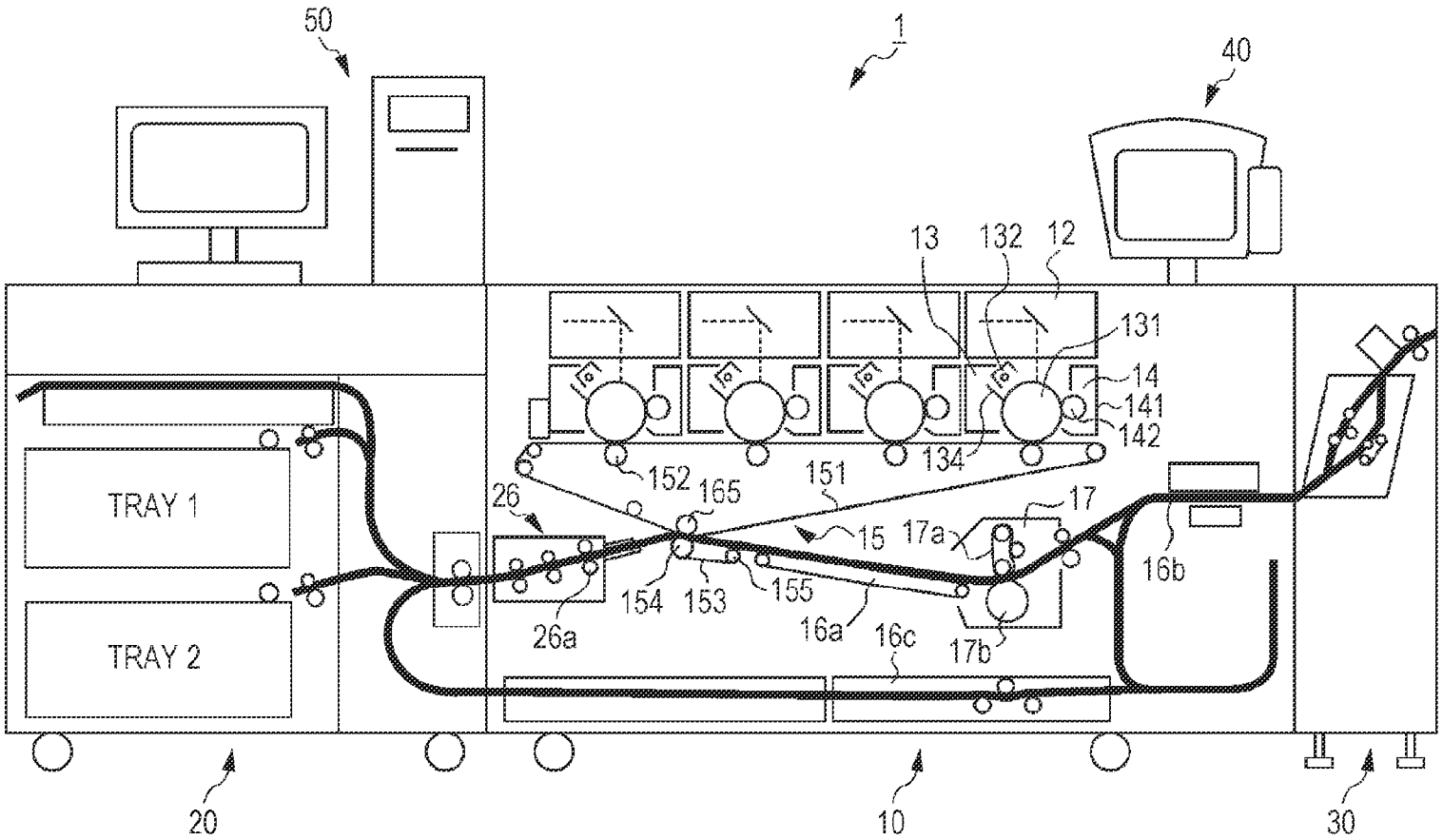
FIG. 1 is a schematic cross-sectional view illustrating an example of a general configuration of an image forming apparatus.

(1) Overall Configuration and Operation of Image Forming Apparatus (1.1) Overall Configuration of Image Forming Apparatus FIG. 1 is a schematic cross-sectional view illustrating an example of a general configuration of an image forming apparatus 1 according to an exemplary embodiment of the present invention.

The image forming apparatus 1 includes an image forming unit 10, a paper feed device 20 that is mounted to one end of the image forming unit 10, a paper discharge unit 30 that is provided at the other end of the image forming unit 10 and from which printed paper is discharged, an operational information unit 40, and an image processing unit 50 that generates image information from print information transmitted from a host apparatus.

The image forming unit 10 includes a system controller (not shown), an exposure device 12, photoconductor units 13, developing devices 14, a transfer device 15, paper transport devices 16*a*, 16*b*, and 16*c*, a fixing device 17, and a driving device (not shown). The image forming unit 10 forms image information received from the image processing unit 50, as a toner image on paper P fed from the paper feed device 20.

The paper feed device 20 supplies paper to the image forming unit 10. That is, the paper feed device 20 includes multiple paper loading units that receive different types (for example, material, thickness, paper size, and paper grain) of paper P. The paper feed device 20 supplies the paper P sent out from one of these multiple paper loading units to the image forming unit 10.

The paper discharge unit 30 discharges the paper P to which an image has been outputted in the image forming unit 10. For this reason, the paper discharge unit 30 has a discharge paper receiving unit to which the paper P that has undergone image output is discharged. The paper discharge unit 30 may have the function of performing post-processing such as cutting or stapling on a bundle of paper outputted from the image forming unit 10.

The operational information unit 40 is used for inputting various settings and instructions, and displaying information. That is, the operational information unit 40 corresponds to a so-called user interface. Specifically, the operational information unit 40 is configured by a combination of a liquid crystal display panel, various operating buttons, a touch panel, and the like.

(1.2) Configuration and Operation of Image Forming Unit

In the image forming apparatus 1 configured as described above, in synchronism with the timing of image formation, each single sheet of the paper P to be printed by a print job sent out from a specified paper loading unit of the paper feed device 20 is fed to the image forming unit 10.

The photoconductor units 13 are provided in parallel below the exposure device 12. Each of the photoconductor units 13 includes a photoconductor drum 131. The photoconductor drum 131 serves as an image carrier that is rotationally driven. A charger 132, the exposure device 12, the developing device 14, a first transfer roller 152, and a cleaning blade 134 are arranged along the rotational direction of the photoconductor drum 131.

Each of the developing devices 14 has a developing housing 141 in which a developer is received. A developing roller 142 opposed to the photoconductor drum 131 is disposed inside the developing housing 141. A layer regulating member (not illustrated) that regulates the layer thickness of developer is arranged in close proximity to the developing roller 142.

The developing devices 14 are configured in substantially the same manner except for the developer received in the corresponding developing housing 141. The developing devices 14 form toner images of yellow (Y), magenta (M), cyan (C), and black (B), respectively.

The surface of the photoconductor drum 131 that rotates is charged by the charger 132. An electrostatic latent image is formed on the surface of the photoconductor drum 131 by latent image-forming light emitted from the exposure device 12. The electrostatic latent image formed on the photoconductor drum 131 is developed as a toner image by the developing roller 142.

The transfer device 15 includes an intermediate transfer belt 151, the first transfer roller 152, and a second transfer belt 153. Toner images of various colors formed on the photoconductor drums 131 of the respective photoconductor units 13 are transferred to the intermediate transfer belt 151 in multiple layers. The first transfer roller 152 sequentially transfers the toner images of various colors formed in the photoconductor units 13 to the intermediate transfer belt 151 (first transfer). The second transfer belt 153 transfers the toner images of various colors that have been transferred onto the intermediate transfer belt 151 in a superimposed manner, to the paper as a recording medium at once (second transfer).

The second transfer belt 153 is stretched by the second transfer roller 154 and a peeling roller 155. The second transfer belt 153 is sandwiched between a backup roller 165 arranged on the back side of the intermediate transfer belt 151, and the second transfer roller 154, thus forming a second transfer part (TR).

The toner images of various colors formed on the photoconductor drums 131 of the respective photoconductor units 13 are electrostatically transferred onto the intermediate transfer belt 151 sequentially (first transfer) by the first transfer roller 152 to which a predetermined transfer voltage is applied from a power supply device (not illustrated) controlled by the system controller, thereby forming superimposed toner images on which various colors of toner are superimposed.

As the intermediate transfer belt 151 moves, the superimposed toner images on the intermediate transfer belt 151 are transported to a region (second transfer part TR) where the second transfer belt 153 is arranged. Once the superimposed toner images are transported to the second transfer part TR, the paper P is supplied to the second transfer part TR from the paper feed device 20 in synchronism with this timing. Then, a predetermined transfer voltage is applied to the backup roller 165 that is opposed to the second transfer roller 154 with the second transfer belt 153 therebetween, from the power supply device or the like controlled by the system controller, and the multilayer toner images on the intermediate transfer belt 151 are transferred onto the paper P at once.

Residual toner on the surface of the photoconductor drum 131 is removed by the cleaning blade 134, and recovered to a waste toner receiving unit (not illustrated). The surface of the photoconductor drum 131 is charged by the charger 132 again.

The fixing device 17 includes an endless fixing belt 17*a* that rotates in one direction, and a pressure roller 17*b* that contacts the peripheral surface of the fixing belt 17*a* and rotates in one direction. A nip part (fixing region) is formed by the press contact region between the fixing belt 17*a* and the pressure roller 17*b*.

The paper P with the toner image transferred in the transfer device 15 is transported to the fixing device 17 via the paper transport device 16*a* in a state in which the toner image has not been fixed yet. The toner image is fixed onto the paper P transported to the fixing device 17 with pressure and heat applied by the pair of the fixing belt 17*a* and the pressure roller 17*b*.

The paper P with the fixed toner image is fed to the paper discharge unit 30 via the paper transport device 16*b*.

In the case of outputting an image onto both sides of the paper P, the front and back sides of the paper P are reversed by the paper transport device 16*c*, and the paper P is fed to the second transfer part TR of the image forming unit 10 again. Then, after a toner image is transferred and the transferred image is fixed onto the paper P, the paper P is fed to the paper discharge unit 30. The paper P fed to the paper discharge unit 30 undergoes post-processing such as cutting or stapling as required, before being discharged to the discharge paper receiving unit.

Figure 2:
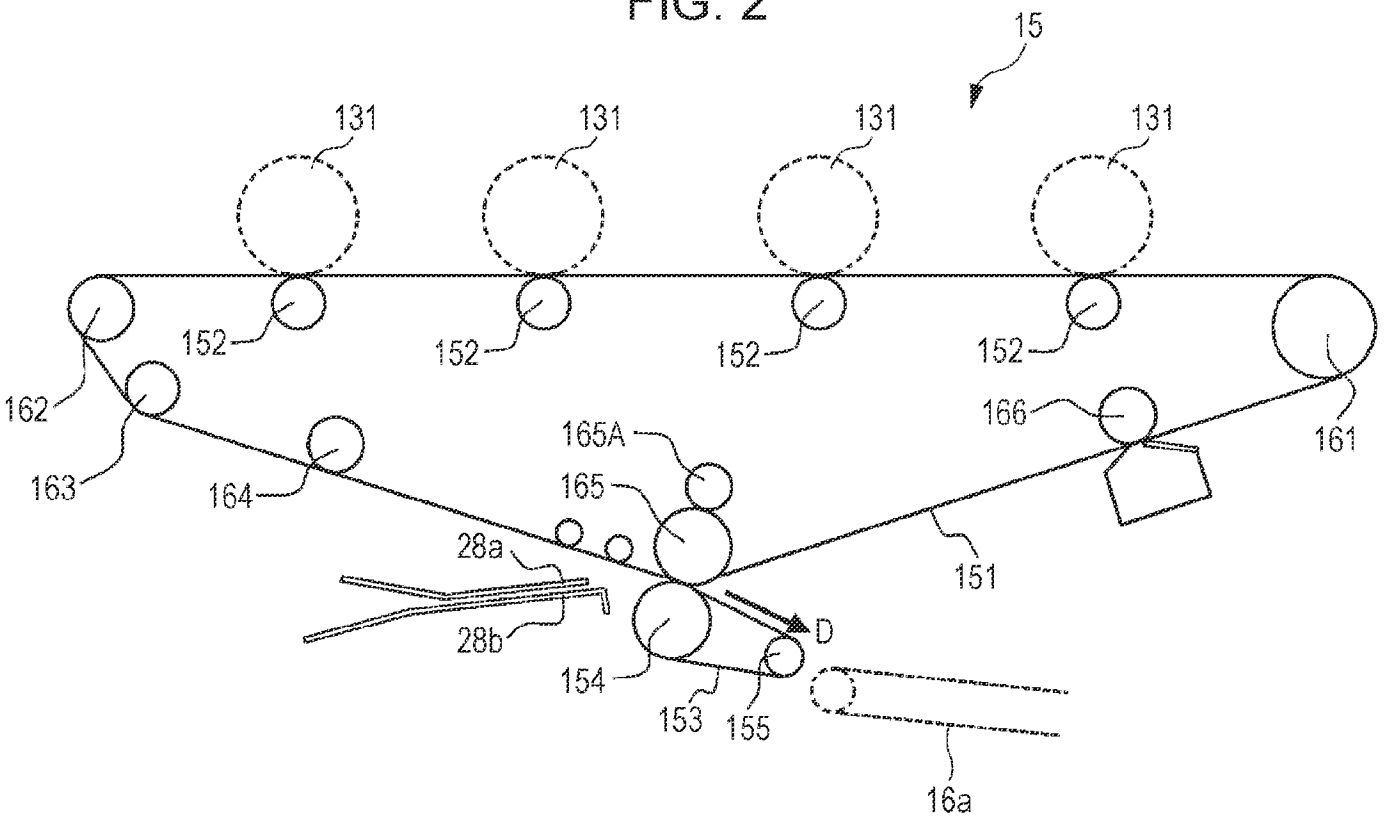
FIG. 2 is a schematic cross-sectional view illustrating a configuration of a transfer device of the image forming apparatus.

(2) Configuration and Action of Transfer Device (2.1) Configuration of Transfer Device FIG. 2 is a schematic cross-sectional view illustrating a configuration of the transfer device 15 of the image forming apparatus 1 according to the exemplary embodiment.

The transfer device 15 includes the intermediate transfer belt 151, the first transfer roller 152, and the second transfer belt 153.

The intermediate transfer belt 151 used is made of resin such as polyimide or polyamide containing a suitable amount of conductive agent such as carbon black, and has a volume resistivity of $10^6$ to $10^{14}$ Ω·cm. The intermediate transfer belt 151 is formed as an endless belt in a film-like form with a thickness of, for example, about 0.1 mm.

The intermediate transfer belt 151 has a driving roller 161, a driven roller 162, a tension roller 163, a support roller 164, the backup roller 165, and a cleaning backup roller 166. The driving roller 161 drives the intermediate transfer belt 151 so as to circulate. The driven roller 162 supports the intermediate transfer belt 151 that extends in a substantially straight line along the arrangement direction of the photoconductor drums 131. The tension roller 163 applies a predetermined tension to the intermediate transfer belt 151 and prevents meandering of the intermediate transfer belt 151. The support roller 164 is provided on the upstream side of the second transfer part TR, and supports the intermediate transfer belt 151. The backup roller 165 is provided in the second transfer part TR. The cleaning backup roller 166 is provided in a cleaning part that scrapes off residual toner on the intermediate transfer belt 151.

The backup roller 165 is a blended rubber tube of EPDM and NBR with carbons dispersed on its surface. The inside of the backup roller 165 is made of EPDM rubber. The backup roller 165 has a surface resistivity of $10^7$ to $10^{10}$ Ω/sq and a roller diameter of 28 mm. The hardness of the backup roller 165 is set to, for example, 70 degrees (Asker-C).

The backup roller 165 is arranged on the back side of the intermediate transfer belt 151, and forms a counter electrode for the second transfer belt 153. A power supply roller 165A made of metal is arranged in contact with the backup roller 165. The power supply roller 165A applies a bias voltage for forming a second transfer electric field in the second transfer part TR.

The first transfer roller 152 is opposed to each of the photoconductor drums 131 with the intermediate transfer belt 151 therebetween. The first transfer roller 152 is applied with a voltage of a polarity opposite to the polarity in which toner is charged. Consequently, toner images on the photoconductor drums 131 are electrostatically attracted to the intermediate transfer belt 151 sequentially, thereby forming superimposed toner images on the intermediate transfer belt 151.

The second transfer belt 153 is a semi-conductive endless annular belt that is made of resin such as polyimide or polyamide containing a suitable amount of conductive agent such as carbon black, and whose volume resistivity is adjusted to, for example, $10^6$ to $10^{10}$ Ω·cm. As illustrated in FIG. 2, the second transfer belt 153 is stretched by the second transfer roller 154 and the peeling roller 155, and is applied with a predetermined tension in advance. Further, in the exemplary embodiment, the second transfer belt 153 receives a driving force from the second transfer roller 154, and rotates in the direction of an arrow D in FIG. 2 at a predetermined speed.

The second transfer roller 154 is made of semi-conductive rubber with a volume resistivity of, for example, $10^6$ to $10^{10}$ Ω·cm. The second transfer roller 154 is opposed to the backup roller 165 with the second transfer belt 153 and the intermediate transfer belt 151 therebetween. The second transfer roller 154 forms the second transfer part TR together with the backup roller 165 where a toner image carried by the intermediate transfer belt 151 is transferred (second transfer) to the paper P being transported on the second transfer belt 153.

Further, a driving motor (not illustrated) is connected to the second transfer roller 154. As the second transfer roller 154 receives a rotational drive force from the driving motor, the second transfer roller 154 rotates, and further causes the second transfer belt 153 to rotate.

The second transfer roller 154 is fixed in position by a second transfer belt holding member 190. The backup roller 165 is rotatably supported by a bearing 171 provided to a backup roller holding member 170.

The backup roller 165 is urged by a moving mechanism described later toward the second transfer roller 154 via the second transfer belt 153, in a constant displacement state according to the basis weight of the paper P. A nip part is formed over a predetermined width between the second transfer roller 154 and the backup roller 165.

As illustrated in FIG. 2, the peeling roller 155 is located on the downstream side of the second transfer roller 154 with respect to the rotational direction (direction of the arrow D in FIG. 2) of the second transfer belt 153. The peeling roller 155 and the second transfer roller 154 form a belt surface for transporting the paper P to the downstream side.

Further, in order to peel the paper P from the surface of the second transfer belt 153, the roller diameter of the peeling roller 155 is set to less than or equal to half the roller diameter of the second transfer roller 154.

A paper guide 28 is arranged on the upstream side of the second transfer part TR of the transfer device 15. The paper guide 28 is opposed to the toner image-carrying surface of the intermediate transfer belt 151, and guides the paper P to the second transfer part TR.

The paper guide 28 includes a paper guide 28*a* that guides the upper surface (transfer surface) of the paper P, and a paper guide 28*b* that guides the lower surface (non-transfer surface) of the paper P.

(2.2) Configuration of Moving Mechanisms

Figure 3A:
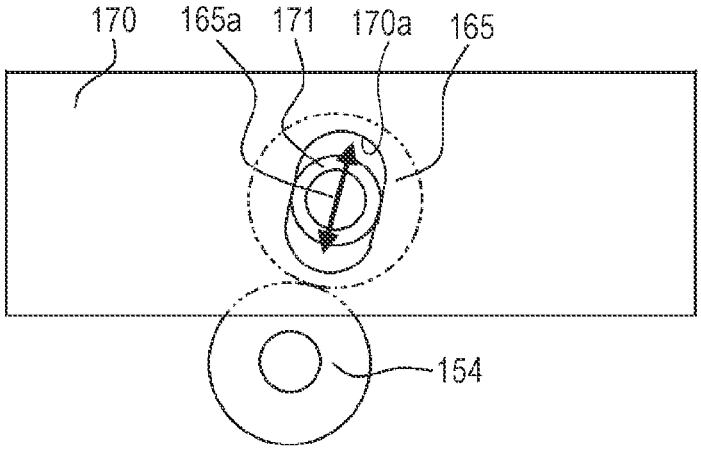
FIGS. 3A and 3B are schematic diagrams each illustrating a configuration of a first moving mechanism of the transfer device.
Figure 3B:
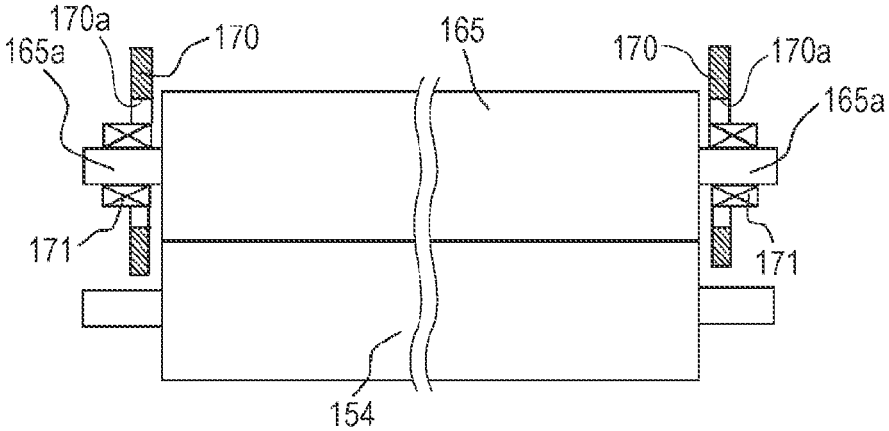
Figure 4A:
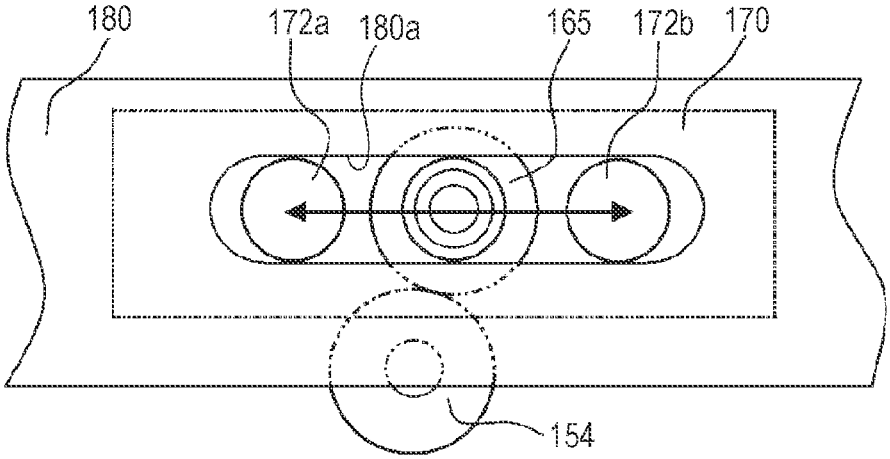
FIGS. 4A and 4B are schematic diagrams each illustrating a configuration of a second moving mechanism of the transfer device.
Figure 4B:
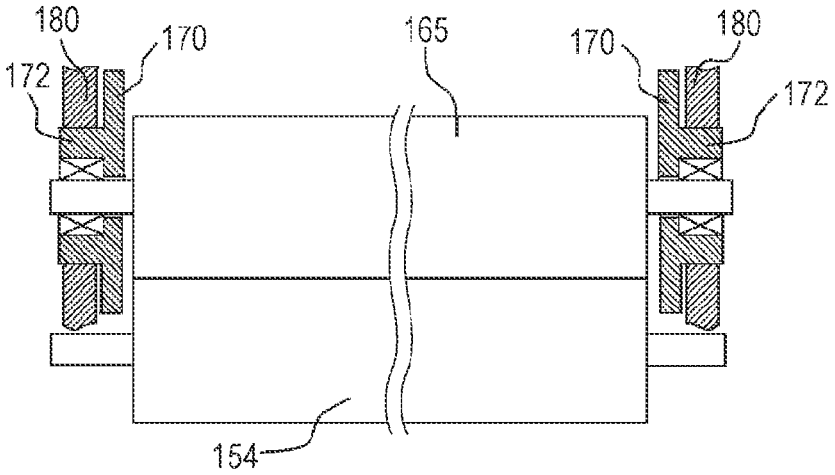
Figure 5A:
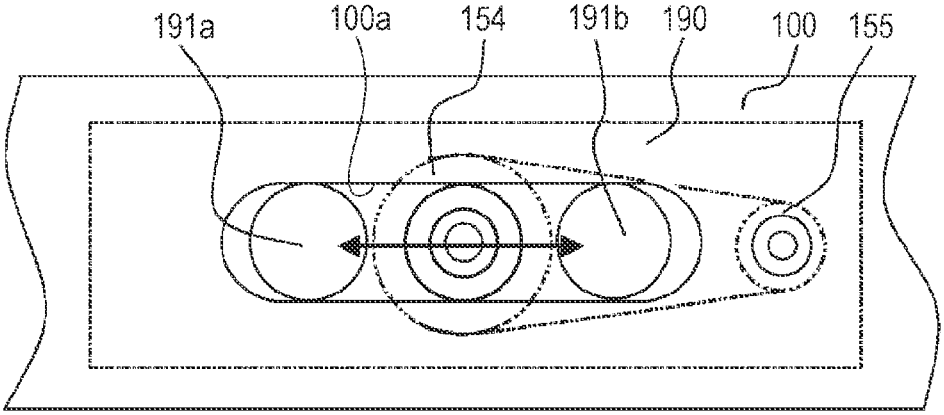
FIGS. 5A and 5B are schematic diagrams each illustrating another configuration of the second moving mechanism of the transfer device.
Figure 5B:
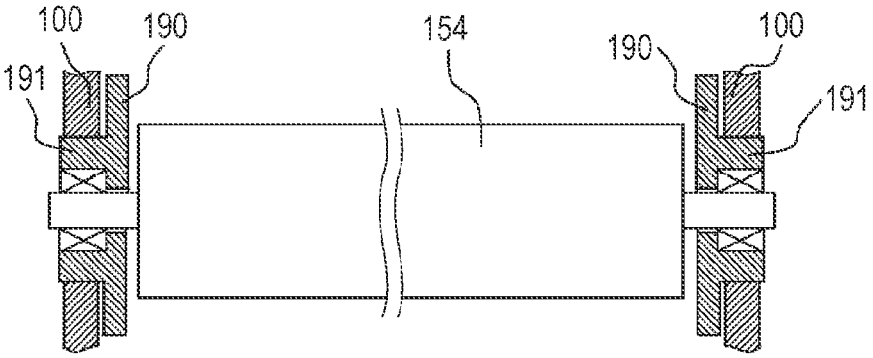

FIGS. 3A and 3B are schematic diagrams each illustrating a configuration of a first moving mechanism that supports the backup roller 165 in a manner that allows the backup roller 165 to move so as to come into abutment with the second transfer roller 154. FIGS. 4A and 4B are schematic diagrams each illustrating a configuration of a second moving mechanism that supports the backup roller 165 in a manner that allows the backup roller 165 to move along a paper transport direction (direction that intersects the normal N to the transfer nip (hereinafter simply referred to as "transfer nip normal N"). FIGS. 5A and 5B are schematic diagrams each illustrating another configuration of the second moving mechanism that supports the second transfer roller 154 and the second transfer belt 153 in a manner that allows the second transfer roller 154 and the second transfer belt 153 to move along the paper transport direction (direction that intersects the transfer nip normal N). Hereinafter, the moving mechanisms for the backup roller 165 will be described with reference to FIGS. 3A to 5B.

As illustrated in FIGS. 3A and 3B, the backup roller 165 is attached to the backup roller holding member 170. A rotating shaft 165*a* is provided at either end portion in the axial direction (direction that intersects the paper transport direction) of the backup roller 165. The rotating shaft 165*a* is rotatably supported on the bearing 171 that is provided inside the backup roller holding member 170.

The bearing 171 is slidably supported in an elongated hole 170*a*. The elongated hole 170*a* is formed so as to penetrate either side wall portion of the backup roller holding member 170. As a first eccentric cam plate (not illustrated) is rotationally driven by the driving motor (not illustrated), the bearing 171 moves in the direction of the longitudinal diameter axis of the elongated hole 170*a*. The longitudinal diameter of the elongated hole 170*a* is in the same direction as the imaginary transfer nip normal N drawn connecting the center B of the backup roller 165 and the center C of the second transfer roller 154 at the second transfer position.

That is, the backup roller 165 is movable inside the backup roller holding member 170 so as to come into abutment with the second transfer roller 154.

Further, as illustrated in FIGS. 4A and 4B, two support shafts 172 (172*a* and 172*b*) protrude from the outer end faces of opposite side wall portions of the backup roller holding member 170. The support shafts 172 are disposed so as to penetrate a transfer device frame 180 that supports the transfer device 15. In order to allow penetration of the support shafts 172, the transfer device frame 180 has an elongated hole 180*a* that is formed along the paper transport direction (direction that intersects the transfer nip normal N).

As a second eccentric cam plate (not illustrated) is rotationally driven by the driving motor (not illustrated), the backup roller holding member 170 moves in the direction of the longitudinal diameter of the elongated hole 180*a*.

According to this configuration, at the second transfer position, the backup roller 165 supported by the backup roller holding member 170 is able to move in the direction of the transfer nip normal N via the intermediate transfer belt 151, thereby making it possible to vary the amount of abutment (amount of bite) with the second transfer roller 154 and the second transfer belt 153.

Further, an offset can be made along the paper transport direction (direction that intersects the transfer nip normal N), which makes it possible to vary the width of contact between the intermediate transfer belt 151, the second transfer roller 154, and the second transfer belt 153 at the second transfer position.

In the exemplary embodiment, an offset means moving the transfer nip normal N formed by the backup roller 165 and the second transfer roller 154, with respect to an imaginary line L connecting the center B of the backup roller 165 and a point A at which the intermediate transfer belt 151 begins its contact with the peripheral surface of the backup roller 165, with the center B of the backup roller 165 as a starting point.

The angle ∠ABC formed by the imaginary line L and the transfer nip normal N is defined as offset angle. Offsetting the second transfer roller 154 to the upstream side of the paper transport direction makes it possible to vary the width of contact between the intermediate transfer belt 151, the second transfer roller 154, and the second transfer belt 153 (see FIG. 6B).

As illustrated in FIGS. 5A and 5B, the second transfer roller 154 and the peeling roller 155 are secured to the second transfer belt holding member 190, with the second transfer belt 153 being stretched by the second transfer roller 154 and the peeling roller 155.

Two support shafts 191 (191*a* and 191*b*) protrude from the outer end faces of opposite side wall portions of the second transfer belt holding member 190. The support shafts 191 are disposed so as to penetrate a frame 100 provided to the body of the image forming apparatus 1.

In order to allow penetration of the support shafts 191, the frame 100 has an elongated hole 100*a* that is formed along the paper transport direction (direction that intersects the transfer nip normal N). The longitudinal diameter of the elongated hole 100*a* is in the same direction as the paper transport direction (direction that intersects the transfer nip normal N).

As a third eccentric cam plate (not illustrated) is rotationally driven by the driving motor (not illustrated), the second transfer belt holding member 190 moves in the direction of the longitudinal diameter of the elongated hole 100*a*.

According to this configuration, the second transfer roller 154 and the second transfer belt 153 that are supported by the second transfer belt holding member 190 are able to move in the paper transport direction (direction that intersects the transfer nip normal N), which makes it possible to vary the width of contact between the intermediate transfer belt 151, the second transfer roller 154, and the second transfer belt 153 at the second transfer position.

(2.3) Action of Transfer Device

Figure 7A:
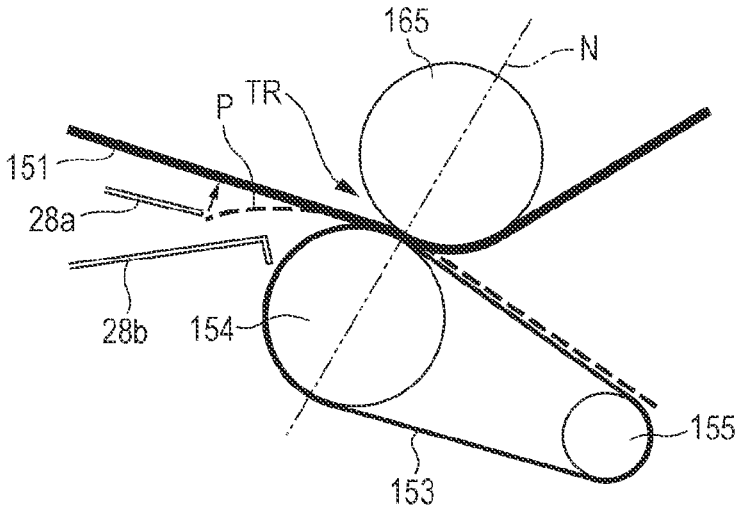
FIGS. 7A and 7B are schematic cross-sectional views of the major portion of the transfer device including a paper guide of the image forming apparatus.
Figure 7B:
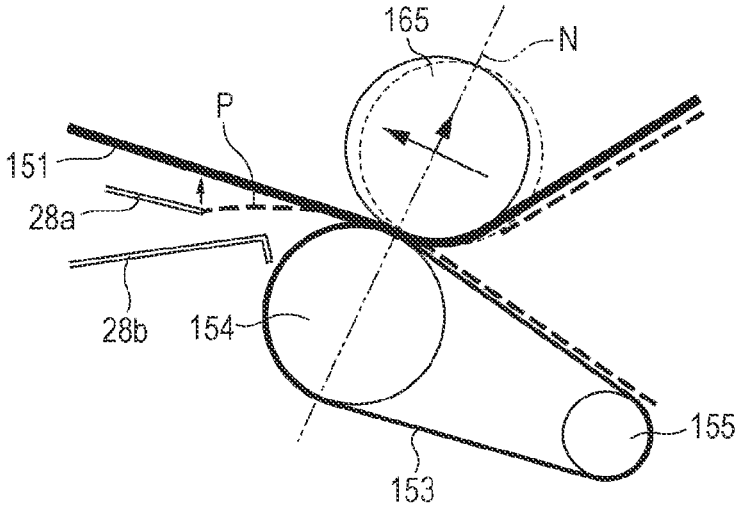

FIGS. 7A and 7B are schematic cross-sectional views of the major portion of the transfer device 15 including the paper guide 28 of the image forming apparatus 1 configured as mentioned above. Hereinafter, the action of the transfer device 15 will be described with reference to FIGS. 7A and 7B.

A toner image formed on the photoconductor drum 131 of each of the photoconductor units 13 is transferred onto the intermediate transfer belt 151 in a first transfer part where each of the photoconductor drums 131 and the intermediate transfer belt 151 are opposed to each other. The unfixed toner image that has undergone the first transfer is transported to the second transfer part TR as the intermediate transfer belt 151 rotates.

The paper feed device 20 supplies the paper P of a predetermined size in synchronism with the timing of image formation. The paper P supplied by the paper feed device 20 reaches the second transfer part TR via an orientation correcting unit 26. The paper P is temporarily stopped, and registration rollers 26*a* are rotated in synchronism with the movement timing of the intermediate transfer belt 151 carrying the toner image, thereby performing registration between the paper P and the toner image.

Then, the paper P transported in a synchronized manner is nipped in the second transfer part TR between the intermediate transfer belt 151 and the second transfer belt 153. The power supply roller 165A forms a transfer electric field by applying a voltage of the same polarity as the polarity in which toner is charged. The transfer electric field thus formed causes the unfixed toner image carried on the intermediate transfer belt 151 to be electrostatically transferred to the paper P, in the second transfer part TR formed by the second transfer roller 154 and the backup roller 165.

Thereafter, the paper P with the electrostatically transferred toner image is transported to the downstream side by the second transfer belt 153, and upon reaching the position of the peeling roller 155, the paper P is peeled from the second transfer belt 153.

Then, the paper P is transported by the paper transport device 16*a* that is provided on the downstream side of the transport direction. The paper transport device 16*a* transports the paper P to the fixing device 17 at a speed suited to a fixing process in the fixing device 17. The fixing device 17 performs a fixing process by application of heat and pressure, thereby fixing the unfixed toner image on the paper P onto the paper P. Then, the paper P with the fixed image is discharged to the paper discharge unit 30 by the paper transport device 16*a*. Residual toner that remains on the intermediate transfer belt 151 after transfer of the image to the paper P is finished is removed by a belt cleaner.

In the image forming apparatus 1, not only general copy papers but various papers are used. For applications aimed at vendors such as publishing and advertising services, toner images are formed on a wide variety of papers such as wood-free paper, wood-containing paper, coated paper, and art paper.

In particular, in a case where a piece of thick paper with a basis weight of 300 g/m$^2$ to 450 g/m$^2$ is used as the paper P, or in a case where a piece of coated paper to which surface coating has been applied to improve smoothness is used as the paper P, an image disturbance can occur owing to the characteristics of the respective papers.

(2.3.1) Thick Paper

Figure 8A:
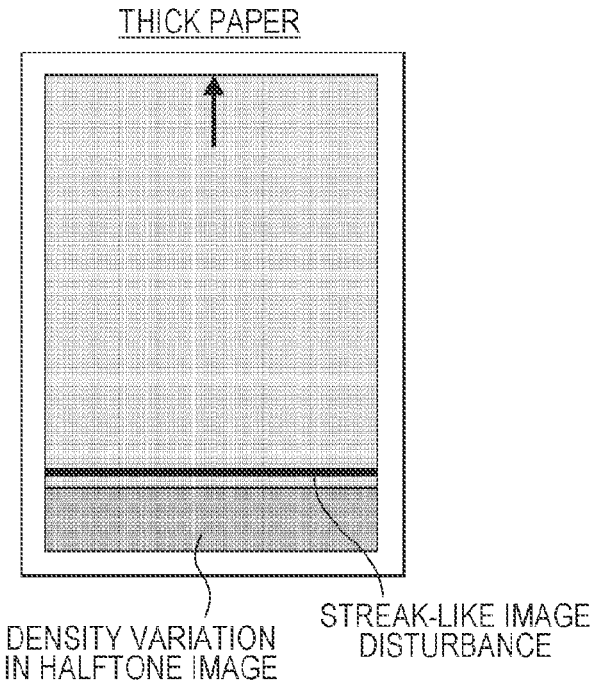
FIGS. 8A and 8B are schematic diagrams each illustrating an example of the image defect to be addressed by an exemplary embodiment of the present invention.

In a case where a piece of thick paper with a basis weight of 300 g/m$^2$ to 450 g/m$^2$ is used as the paper P, when the trailing edge of the paper P passes the distal end of the paper guide 28*a* and is released from constraint, and comes into contact with the outer peripheral surface of the intermediate transfer belt 151, a streak-like image disturbance may occur in the image being transferred in the second transfer part TR in some cases (see FIG. 8A).

When the trailing edge of the paper P passes the distal end of the paper guide 28*a* that guides the upper surface (transfer surface) of the paper P, a force is applied to the paper P in the direction of the transfer nip normal N which connects the center of the backup roller 165 and the center of the second transfer roller 154 (see FIG. 7A). In a case where the paper used is a piece of thick paper and thus has increased stiffness, the force acting in the direction of the transfer nip normal becomes an impact force when the trailing edge collides against the surface of the intermediate transfer belt 151, causing the intermediate transfer belt 151 to vibrate so as to be displaced at right angles to the peripheral surface. It is assumed that such vibration is transmitted to a transfer position P1, causing a streak-like image disturbance to occur in the image being transferred.

As the intermediate transfer belt 151 and the paper P vibrate owing to this impact force, a minute gap formed between the surfaces of the intermediate transfer belt 151 and second transfer belt 153 in a region located upstream of a region where the second transfer roller 154 and the backup roller 165 are strongly pressed against each other at the transfer position P1 changes, with the result that the second transfer electric field becomes unstable, causing an image disturbance (density variation in a halftone image or the like) in the trailing edge portion of the paper in some cases (see FIG. 8A).

In the image forming apparatus 1 according to the exemplary embodiment, on the basis of the basis weight of the paper P as paper attribute information (such as the material, thickness, size, and paper grain of the paper), the system controller varies the amount of bite by causing the first moving mechanism to press or separate the backup roller 165 against or from the second transfer roller 154 in the direction of the transfer nip normal N. Then, the system controller causes the second moving mechanism to offset the backup roller 165 in the paper transfer direction (direction that intersects the transfer nip normal N), thereby varying the width of contact between the intermediate transfer belt 151, the second transfer roller 154, and the second transfer belt 153.

Specifically, in a case where the paper P is a piece of thick paper, the amount of bite in the direction of the transfer nip normal N at the second transfer position is reduced. In addition, the backup roller 165 is offset to the upstream side of the paper transport direction (direction that intersects the transfer nip normal), thereby reducing the width of contact between the intermediate transfer belt 151, the second transfer roller 154, and the second transfer belt 153 (see FIG. 7B).

Owing to this change, the force that acts in the direction of the transfer nip normal when the trailing edge of the paper P passes the distal end of the paper guide 28*a* decreases. As a result, the impact force exerted when the trailing edge collides against the surface of the intermediate transfer belt 151 decreases, thereby reducing a streak-like image disturbance that occurs in the image being transferred.

Experiment 1

Image formation is performed under the following conditions by the image forming apparatus 1 according to the exemplary embodiment, and an effect checking test is conducted by evaluating a streak-like image disturbance that occurs in the image being transferred by comparison against a comparative example. The results of the test will be described below.

Figure 6A:
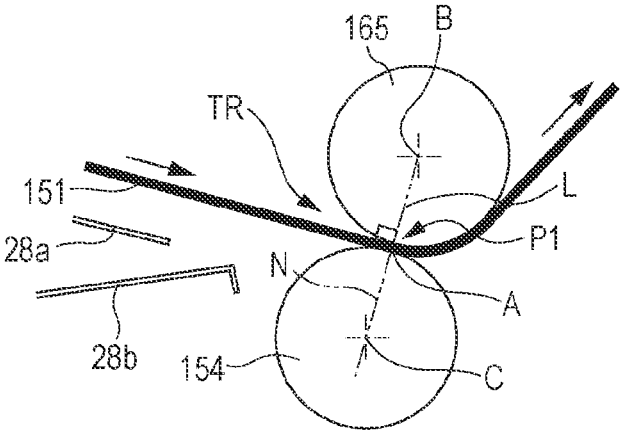
FIGS. 6A and 6B are schematic cross-sectional views for explaining offset between a second transfer member and an opposed member at a second transfer position.
Figure 6B:
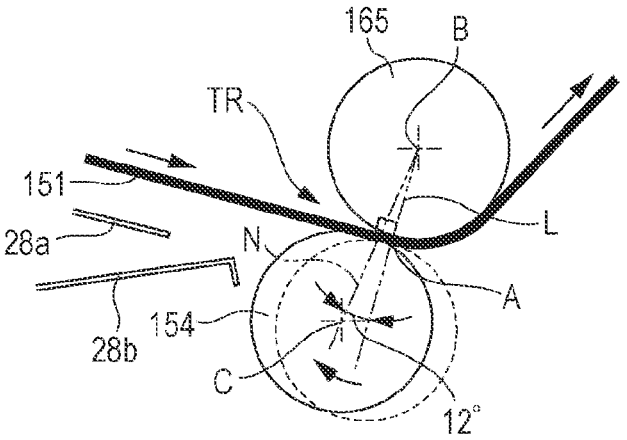

With the case illustrated in FIG. 6B where the offset angle is 12° taken as the comparative example, image formation is performed while changing the offset angle.

(Test Conditions)

Print speed: 440 mm/s

Paper basis weight: 300 g/m$^2$

External environment temperature: 22° C./55% RH (Evaluation Criteria for Streak-like Image Disturbance)

G0: None

G1: Slight

G2: Visible

G3: Clearly visible

G4: Dark and long

As the image for evaluation, the halftone image pattern illustrated in FIG. 8A is used.

In the image forming apparatus 1 according to the exemplary embodiment, the amount of bite of the backup roller 165 is reduced from 0.9 mm to 0.3 mm by the first moving mechanism that serves as a changing section that changes the contact position of the backup roller 165 with the intermediate transfer belt 151 at the second transfer position TR, and the backup roller 165 is offset by the second moving mechanism to the upstream side of the paper transport direction (direction that intersects the transfer nip normal N) at offset angles of 10°, 8°, and 6°, as opposed to the offset angle of the comparative example (12°), thereby reducing the width of contact between the intermediate transfer belt 151, the second transfer roller 154, and the second transfer belt 153.

Figures 10, 11:
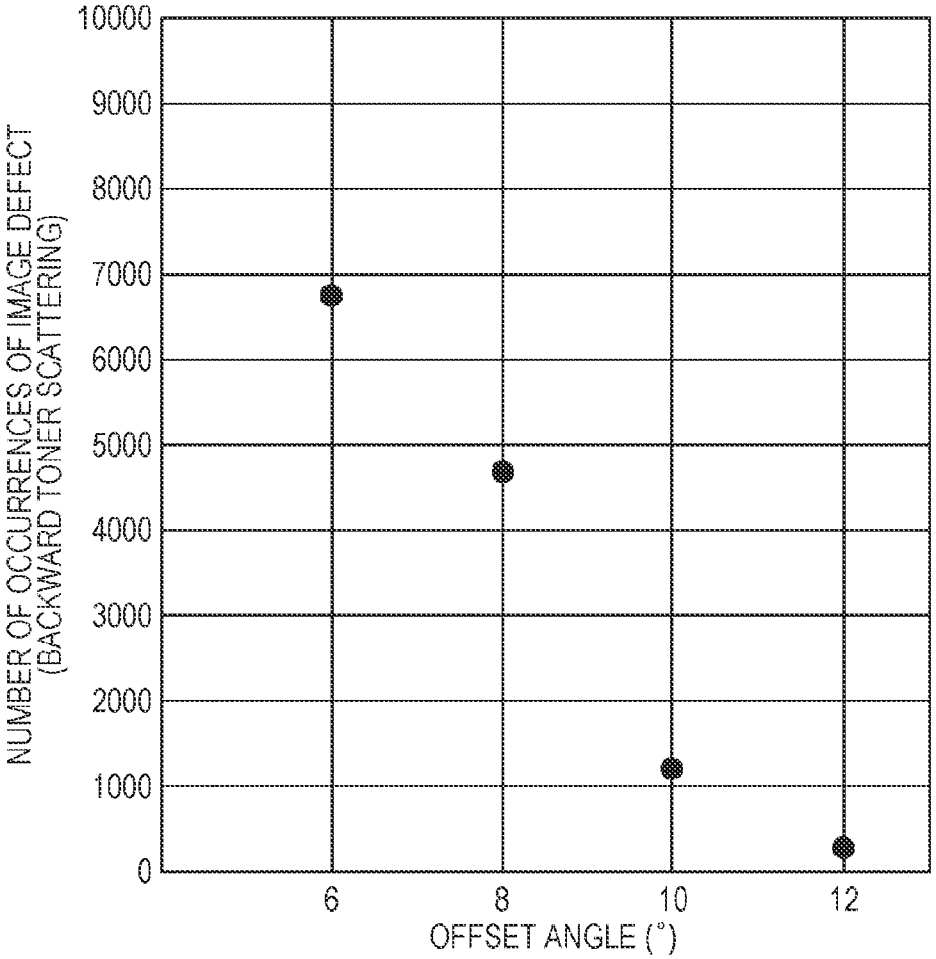
FIG. 10 illustrates the relationship between the offset position of a backup roller and a streak-like image disturbance that occurs in the image being transferred.
FIG. 11 illustrates the relationship between the offset position of the backup roller and an image defect in which toner scatters backwards in the travelling direction.

As illustrated in FIG. 10, at the offset angle of the comparative example (12°), a dark and long streak-like image disturbance (G4) occurs.

As the offset angle of the backup roller 165 is decreased to 10°, 8°, and then 6°, the level of the streak-like image disturbance improves to G3, G2, and then G1.5 (intermediate state between G1 and G2), respectively.

It is appreciated from the above discussion that the impact force exerted when the trailing edge of the paper P passes the distal end of the paper guide 28*a* and collides against the surface of the intermediate transfer belt 151 is mitigated, thereby reducing a streak-like image disturbance that tends to occur in the image being transferred at the second transfer position TR.

(2.3.2) Coated Paper

Figure 8B:
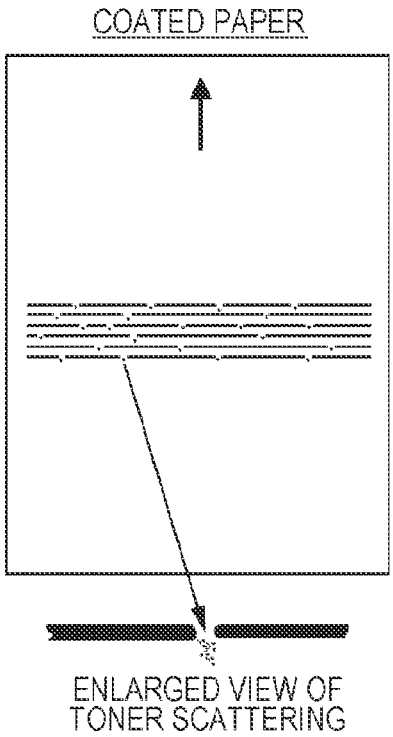

In a case where the paper P used is a piece of coated paper to which surface coating has been applied to improve smoothness, the following image defect occurs in some cases. That is, toner scatters backwards in the travelling direction of the paper P immediately before entering the region where the second transfer roller 154 and the backup roller 165 are strongly pressed against each other at the second transfer position TR (see FIG. 8B). Such an image defect tends to occur in a case where the toner image to be formed includes multiple thin lines running at right angles to the travelling direction of the paper P.

Figure 9:
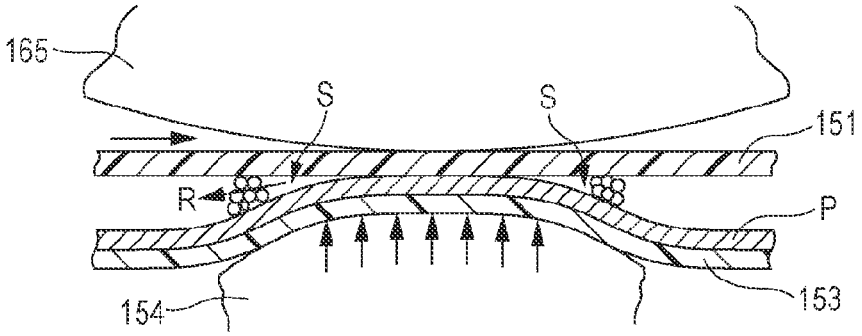
FIG. 9 is a schematic diagram for explaining the probable cause of the image defect to be addressed by the exemplary embodiment of the present invention.

On the upstream side of the region where the second transfer roller 154 and the backup roller 165 are strongly pressed against each other, the intermediate transfer belt 151 and the paper P are laid over each other as illustrated in FIG. 9, and the back surface of the paper P comes into contact with the intermediate transfer belt 151. At this time, toner on the intermediate transfer belt 151 becomes lodged in between the intermediate transfer belt 151 and the paper P, and a space S is formed between thin lines of toner located on the forward side and thin lines of toner located on the backward side.

When the paper P enters the region where the second transfer roller 154 and the backup roller 165 are strongly pressed against each other at the second transfer position, this space S is crushed from the forward side by a large press contact force exerted at this time. In the case of an image including multiple thin lines running at right angles to the travelling direction of the paper P, for example, the air within the space S becomes confined, making it difficult for a discharge path for the air to form.

Consequently, when the space S is crushed from the forward side, as indicated by an arrow R in FIG. 9, a group of toner particles forming thin lines on the backward side where the press contact force is weak is blown away by the air pressure, and thus the air within the space S is released to the backward side. It is assumed that toner forming thin lines on the backward side is thus scattered backwards.

In the image forming apparatus 1 according to the exemplary embodiment, in accordance with the paper material as paper attribute information, the system controller causes the second moving mechanism to offset the backup roller 165 along the paper transport direction (direction that intersects the transfer nip normal N), thereby varying the width of contact between the intermediate transfer belt 151, the second transfer roller 154, and the second transfer belt 153.

Specifically, in a case where the paper P is a piece of coated paper, the backup roller 165 is moved to the downstream side of the paper transport direction (direction that intersects the transfer nip normal N), thereby increasing the width of contact between the intermediate transfer belt 151, the second transfer roller 154, and the second transfer belt 153.

As a result, a force that constrains toner lodged in between the intermediate transfer belt 151 and the paper P is generated in a transfer pre-nip part, thereby keeping toner from scattering backwards in the travelling direction immediately before entering the region where the second transfer roller 154 and the backup roller 165 are strongly pressed against each other.

When offsetting the backup roller 165 to the downstream side, if the backup roller 165 is offset in such a way as to decrease the pressing force between the second transfer roller 154 and the backup roller 165, less compressive force is exerted on the space S formed between thin lines of toner located on the forward side and thin lines of toner located on the backward side, thereby more effectively reducing the occurrence of an image defect in which toner scatters backwards in the travelling direction immediately entering the second transfer position.

Experiment 2

Image formation is performed under the following conditions by the image forming apparatus 1 according to the exemplary embodiment. The relationship between the frequency of occurrence of an image defect in which toner scatters backwards, and the amount of offset by which the backup roller 165 is moved along the paper transport direction (direction that intersects the transfer nip normal N) in this case will be described.

(Test Conditions)

Print speed: 440 mm/sec

Paper basis weight: 127 g/m$^2$

Paper type: coated paper

External environment temperature: 22° C./55% RH

Image: monochrome image with a line width of 0.3 mm and a thin line pitch of 2.5 mm As an image typically prone to an image defect in which toner scatters backwards, a monochrome image with a line width of 0.3 mm and a thin line pitch of 2.5 mm is formed on the intermediate transfer belt 151, and after being transferred onto the paper P at the second transfer position, the monochrome image is fixed onto the paper P. Then, the number of locations where a defect in which toner scatters backwards has occurred is counted, and the counted value is used as an evaluation characteristic value. The counting is performed by reading the image forming surface of the paper P with an image reading device according to related art.

FIG. 11 illustrates, as relative values, the numbers of occurrences of an image defect when the backup roller 165 is moved along the paper transport direction (direction that intersects the transfer nip normal N) to vary the width of contact between the intermediate transfer belt 151, the second transfer roller 154, and the second transfer belt 153.

As illustrated in FIG. 11, as the width of contact between the intermediate transfer belt 151, the second transfer roller 154, and the second transfer belt 153 is increased by offsetting the backup roller 165 at offset angles of 6°, 8°, 10°, and then 12° to the downstream side of the paper transport direction (direction that intersects the transfer nip normal N), the number of occurrences of an image defect is reduced.

While each of the first moving mechanism and the second moving mechanism moves the backup roller 165 in Experiment 1 and Experiment 2 mentioned above, each of the first moving mechanism and the second moving mechanism may move the second transfer roller 154.

While the exemplary embodiment of the present invention has been described in detail above, the present invention is not limited to the exemplary embodiment mentioned above but various modifications are possible within the scope of the present invention as defined by the claims.

For example, while the image forming apparatus 1 according to the exemplary embodiment has been described as a tandem color printer using an intermediate transfer belt which employs a second transfer belt system, the present invention is also applicable to an image forming apparatus employing a second transfer roller system which does not have a second transfer belt.

What is claimed is:

1. An image forming apparatus comprising:

an intermediate transfer belt that is stretched by a plurality of rollers, the intermediate transfer belt transporting a toner image on an outer peripheral surface;

a second transfer member that performs second transfer, the second transfer transferring the toner image on the intermediate transfer belt to a recording medium;

an opposed member that abuts against an inner peripheral surface of the intermediate transfer belt, the opposed member being opposed to the second transfer member; and a changing section that changes a contact length between the intermediate transfer belt and the second transfer member at a second transfer position by changing a position of the opposed member, on a basis of paper attribute information of the recording medium, the second transfer position being a position where the second transfer member abuts against the opposed member with the intermediate transfer belt being sandwiched between the second transfer member and the opposed member, wherein the opposed member is in contact with the second transfer member via the intermediate transfer belt.

2. The image forming apparatus according to claim 1, wherein when the paper attribute information indicates that the recording medium is a recording medium having a thickness greater than or equal to a predetermined thickness, the changing section changes the contact length between the intermediate transfer belt and the second transfer member so as to decrease.

3. The image forming apparatus according to claim 2, wherein when the paper attribute information indicates that the recording medium is a recording medium having a thickness greater than or equal to a predetermined thickness, the changing section further changes a pressing force so as to decrease, the pressing force being generated between the second transfer member and the opposed member opposed to the second transfer member with the intermediate transfer belt being sandwiched between the second transfer member and the opposed member.

4. The image forming apparatus according to claim 1, wherein when the paper attribute information indicates that the recording medium is a recording medium having a thickness less than or equal to a predetermined thickness, the changing section changes the contact length between the intermediate transfer belt and the second transfer member so as to increase.

5. The image forming apparatus according to claim 4, wherein when the paper attribute information indicates that the recording medium is a recording medium having a thickness less than or equal to a predetermined thickness, the changing section further changes a pressing force so as to increase, the pressing force being generated between the second transfer member and the opposed member opposed to the second transfer member with the intermediate transfer belt being sandwiched between the second transfer member and the opposed member.

6. The image forming apparatus according to claim 1, wherein when the paper attribute information indicates that the recording medium is a recording medium whose recording surface has a coating layer, the changing section changes the contact length between the intermediate transfer belt and the second transfer member so as to increase.

7. The image forming apparatus according to claim 6, wherein when the paper attribute information indicates that the recording medium is a recording medium whose recording surface has a coating layer, the changing section further changes a pressing force so as to decrease, the pressing force being generated between the second transfer member and the opposed member opposed to the second transfer member with the intermediate transfer belt being sandwiched between the second transfer member and the opposed member.

8. The image forming apparatus according to claim 1, wherein when the paper attribute information indicates that the recording medium is a recording medium having a basis weight greater than or equal to a predetermined basis weight, the changing section changes the contact length between the intermediate transfer belt and the second transfer member so as to decrease.

9. The image forming apparatus according to claim 8, wherein when the paper attribute information indicates that the recording medium is a recording medium having a basis weight greater than or equal to a predetermined basis weight, the changing section further changes a pressing force so as to decrease, the pressing force being generated between the second transfer member and the opposed member opposed to the second transfer member with the intermediate transfer belt being sandwiched between the second transfer member and the opposed member.

10. The image forming apparatus according to claim 1, wherein when the paper attribute information indicates that the recording medium is a recording medium having a basis weight less than or equal to a predetermined basis weight, the changing section changes the contact length between the intermediate transfer belt and the second transfer member so as to increase.

11. The image forming apparatus according to claim 10, wherein when the paper attribute information indicates that the recording medium is a recording medium having a basis weight less than or equal to a predetermined basis weight, the changing section further changes a pressing force so as to increase, the pressing force being generated between the second transfer member and the opposed member opposed to the second transfer member with the intermediate transfer belt being sandwiched between the second transfer member and the opposed member.

12. An image forming apparatus comprising:

an intermediate transfer belt that is stretched by a plurality of rollers, the intermediate transfer belt transporting a toner image on an outer peripheral surface;

a second transfer belt that performs second transfer, the second transfer transferring the toner image on the intermediate transfer belt to a recording medium, the second transfer belt stretched by the second transfer roller and another member, the second transfer roller having a second wrapped area where the second transfer belt wraps a surface of the second transfer roller;

an opposed member that abuts against an inner peripheral surface of the intermediate transfer belt, the opposed member being opposed to the second transfer belt; and a changing section that changes contact length between the intermediate transfer belt and the second transfer member at a second transfer position by changing a position of the opposed member so as to change the second wrapped area, on a basis of paper attribute information of the recording medium, the second transfer position being a position where the second transfer member abuts against the opposed member with the intermediate transfer belt being sandwiched between the second transfer member and the opposed member, wherein the opposed member is in contact with the second transfer member via the intermediate transfer belt.

13. The image forming apparatus according to claim 12, wherein the changing section changes the contact length by changing a position of the opposed member by moving the opposed member in a transfer direction of the recording medium.

* * * * *